United States Patent [19]

Masumoto et al.

[11] 4,415,529

[45] Nov. 15, 1983

[54] MN-BASED ALLOY OF NONEQUILIBRIUM AUSTENITE PHASE

[75] Inventors: Tsuyoshi Masumoto; Akihisa Inoue, both of Sendai; Hiroyuki Tomioka, Uji, all of Japan

[73] Assignees: Unitika Ltd., Amagasaki; Tsuyoshi Masumoto, Sendai, both of Japan

[21] Appl. No.: 426,442

[22] Filed: Sep. 29, 1982

[30] Foreign Application Priority Data

Sept. 29, 1981 [JP] Japan .....56.154064

[51] Int. Cl.[3] ..... H01F 1/00; C22C 28/00

[52] U.S. Cl. ..... 420/434

[58] Field of Search ..... 420/434

[56] References Cited

U.S. PATENT DOCUMENTS 4,023,991 5/1977 Kubo ..... 420/434

*Primary Examiner*—Peter D. Rosenberg

*Attorney, Agent, or Firm*—Sughrue, Mion, Zinn, Macpeak and Seas

[57] ABSTRACT

A Mn-based alloy is disclosed. The alloy is comprised of 4 to 30 atomic % of at least one element selected from the group consisting of Al, Ni, and Cr; 1 to 15 atomic % of C, 30 atomic % or less of at least one element selected from the group consisting of Co, Mo, W, Ta, Nb, V, Ti, and Zr; and the balance of alloy making up 100 atomic % being comprised substantially of Mn. The alloy has a nonequilibrium austenite phase. The alloy disclosed has high ductility and workability. The alloy is capable of being cold worked and has excellent tensile strength. The Mn-based alloy can be produced at substantially the same cost as any Fe-based alloy. The disclosed alloy is a nonmagnetic alloy which has been found to be very useful for nonmagnetic electromagnetic parts and composite materials.

7 Claims, No Drawings

MN-BASED ALLOY OF NONEQUILIBRIUM AUSTENITE PHASE

FIELD OF THE INVENTION

This invention relates to a Mn-based alloy of nonequilibrium austenite phase which possesses excellent tensile strength and high ductility.

BACKGROUND OF THE INVENTION

Conventional Mn-based alloy assumes an A-12 type α-Mn structure containing 58 atoms in the unit cell at room temperature. Therefore, the alloy is too brittle to be normally worked or formed. Therefore, an inexpensive Mn-Al powder alloy has been formed to have a small amount of utility as a material for a magnet. None of the Mn-based alloys existing today possess any appreciable degree of strength, elongation and high ductility.

SUMMARY OF THE INVENTION

An object of this invention is to provide a Mn-based alloy which is very rich in ductility and workability, capable of being cold worked, and excellent in mechanical properties including tensile strength. Another object of this invention is to provide a Mn-based alloy which is useful in a great variety of products such as nonmagnetic electromagnetic parts, composite materials, and textile materials.

As a result of diligent efforts to meet the objects described above, the present inventors have found that a Mn-based alloy of a specific composition, when solidified by quenching, retains intact (even at room temperature) an austenite phase which is stable only at elevated temperatures. The Mn-based alloy having a nonequilibrium austenite phase at room temperature is very rich in ductility and workability and capable of being cold worked.

More specifically, the invention is directed to providing a Mn-based alloy having a nonequilibrium austenite phase. The alloy is produced by solidifying by quenching an alloy comprising 4 to 30 atomic % of at least one element selected from the group consisting of Al, Ni, and Cr, 1 to 15 atomic % of C, not more than 30 atomic % of at least one element selected from the group consisting of Co, Mo, W, Ta, Nb, V, Ti, and Zr. The balance of the alloy making up 100 atomic % is comprised substantially of Mn. The Mn-based alloy of a nonequilibrium austenite phase provided by this invention is very rich in ductility and workability. Furthermore, the alloy is capable of being cold worked, excellent in mechanical properties including tensile strength, inexpensive and, therefore, is highly used in nonmagnetic electromagnetic parts, composite materials, textile materials, etc.

DETAILED DESCRIPTION OF PREFERRED EMBODIMENT

The Mn-based alloy of a nonequilibrium austenite phase according to this invention is obtained by quenching and solidifying a molten alloy which comprises 4 to 30 atomic % of at least one element selected from the group consisting of Al, Ni, and Cr, 1 to 15 atomic % of C, not more than 30 atomic % of at least one element selected from the group consisting of Co, Mo, W, Ta, Nb, V, Ti, and Zr, and the balance to make up 100 atomic % being comprised substantially of Mn.

The Mn-based alloy of the invention will now be described. It contains at least one element selected from the group consisting of Al, Ni, and Cr in a concentration of 4 to 30 atomic %. The elements and percentages amounts described above represent the metallic elements and the amounts which are essential for the purpose of enabling a Mn-alloy in a molten state to be solidified by quenching into a tough Mn-based alloy, whereby the austenite phase which is stable only at elevated temperatures is supercooled intact to room temperature. If the atomic % amount of these elements is less than 4 atomic %, the alloy produced will have very high brittleness because it can no longer be expected to enjoy the effect described above and further because the alloy suffers precipitation of an α-Mn phase.

An alloy which does not contain the indicated atomic % amounts of metals cannot be used to produce continuous ribbons and thin wires of fixed shapes. If the concentration exceeds 30 atomic %, the alloy to be produced is rigid and brittle due to the precipitation of an intermetallic compound MnX (X denoting Ni, Al, or Cr). Thus, the alloy lacks practicability. The elongation of the alloy material is effected by the amounts of Al, Ni and/or Cr to be present. As the amount of these components increases, the elongation of the alloy decreases. The tensile strength is not affected much by the content of Al and is liable to increase with the content of Ni and/or Cr. The Mn-based alloy of this invention further contains C in a concentration in the range of 1 to 15 atomic %. The carbon must be present in this amount to enable the austenite phase to be cooled down intact to room temperature when the molten Mn-based alloy is solidified by quenching. If the concentration is less than 1 atomic %, the alloy obtained produces the nonequilibrium austenite phase at room temperature with difficulty and shows very high brittleness because the quenching does not easily manifest its effect. If the concentration exceeds 15 atomic %, the produced alloy is brittle due to the precipitation of a carbide $Mn_{23}C_6$.

When at least one element selected from the group consisting of Co, Mo, W, Ta, Nb, V, Ti, and Zr is contained in a concentration of not more than 30 atomic %, the Mn in the austenite phase which is stable only at elevated temperatures improves the mechanical properties of the alloy such as tensile strength. This improvement is brought about without impeding the conversion of the austenite phase, by quenching, into the nonequilibrium austenite phase which is stable even at room temperature. However, if the concentration of the elements exceeds 30 atomic %, the Mn-based alloy will be too brittle to be useful due to the precipitation of a MnY (Y denoting Co, Mo, W, Ta, Nb, V, Ti, and/or Zr) type compound. Particularly in the aforementioned alloy composition, an alloy composed of 7 to 26 atomic % of at least one element selected from the group consisting of Al, Ni and Cr, 3 to 10 atomic % of C, not more than 30 atomic % of at least one element selected from the group consisting of Co, Mo, W, Ta, Nb, V, Ti and Zr (providing that Co have concentration not exceeding 30 atomic %, Mo and/or W have concentration not exceeding 20 atomic % and the at least one element selected from the group consisting of Ta, Nb, V, Ti and Zr have concentration not exceeding 10 atomic %), and the balance to make up 100 atomic % being comprised substantially of Mn (e.g., 25 to 95 atomic % of Mn), when converted from its molten state by quenching into a solid state, assumes a highly tough austenite phase.

The Mn-based alloy of the present invention is highly desirable because uniform ribbons or thin wires of a circular cross section can be manufactured from this alloy. Moreover, the Mn-based alloy of this composition is capable of being cold rolled or cold drawn. Particularly with respect to wire drawing, it should be noted that the workability such as cold drawing of this alloy can be effected to more than 90% of reduction of area. The alloy is advantageous in that the tensile strength at fracture notably increases proportionally with respect to increases in the area of reduction. The alloy has been found to be highly suitable for economic production of nonferrous and nonmagnetic heavy-duty metal fibers having diameters not exceeding about 150 μm, preferably 50 μm or more. The reduction ratio of area is represented by the following equation:

$$\frac{D^2 - d^2}{D^2} \times 100$$

wherein D is a diameter of wire before the wire drawing and d is a diameter of the thin wire after repeatedly wire drawing. That is, it shows the reduction ratio of the cross section of thin wire to be reduced in accordance with subjecting to the drawing workability.

An alloy of the present invention may include additional elements such as Si, B, P, Ge, Cu, and Hf in addition to the essential elements of this invention provided in that these additional elements are only present within a range in which the objects and effects of this invention are not impaired by their presence.

The particular diameter of microcrystals in the nonequilibrium austenite phase varys with the alloy composition and cooling speed. However, it should be pointed out that it is the successful formation of the austenite phase and not the magnitude of the particle diameter of the crystals which is important.

The alloy of this invention is produced by preparing a molten alloy in the aforementioned composition and quenching this molten alloy. Various methods are available for effecting this quenching. For example, the single roll method, the double roll method, and the submerged rotary spinning method which are liquid quenching methods are particularly effective. Plates of the alloy may be produced by the piston-anvil method, the splat etching method, etc. The aforementioned liquid quenching methods (single roll method, double room method, or submerged rotary spinning method) have a cooling speed in the range of about $10^{4}$° to $10^{5}$° C./sec., while the piston-anvil method or the splat etching method has a cooling speed in the range of about $10^{5}$° to $10^{6}$° C./sec. By using some of these quenching methods, therefore, the quenching of the molten alloy can be efficiently carried out. The term "submerged rotary spinning method" refers to a method as disclosed in Japanese Patent Application (OPI) No. 64948/80 (The term "OPI" as used herein refers to a "published unexamined Japanese patent application.") The "submerged rotary spinning method" is a method for obtaining a thin wire of a circular cross section by placing water in a rotary drum in motion thereby centrifugally forming a film of water on the inner wall surface of the drum and extruding molten alloy through a spinning nozzle into the water film. To produce a continuous thin wire uniformly by this method, the peripheral speed of the rotary drum is preferably equal to or greater than the speed of the flow of molten alloy being thrown out of the spinning nozzle. Particularly, the peripheral speed of the rotary drum is preferably 5 to 30% high than the speed of the flow of molten alloy extruded through the spinning nozzle. The angle formed between the flow of molten metal extruded through the spinning nozzle and the water film formed on the inner wall surface of the rotary drum is preferably greater than 20°.

The Mn-based alloy of this invention has a wider range of equilibrium austenite phase at elevated temperatures than the Fe-based alloy. It, therefore, acquires the nonequilibrium austenite phase at room temperature over a wide range of alloy compositions. At the same time, it enjoys stability because it is capable of keeping the austenite phase from converting into martensite. Particularly, the alloy acquires a large thick austenite phase as compared with the Fe-X-C (X denoting Cr, Mo, W, or Al) alloy. This fact is profoundly significant from the industrial point of view. When the Mn-based alloy incorporates Cr, among other elements of the same group, it becomes highly resistant to corrosion. Therefore, the alloy may be used in nonmagnetic corrosion-proofing materials.

Moreover, the Mn-based alloy of this invention is capable of being cold worked continuously. For the production of thin wires, for example, this Mn-based alloy can be cold drawn to economically form wires of high tensile strength having diameters in the range of 1 to 200 μm. It is noteworthy that the tensile strength of the Mn-based alloy can be improved to even more than 150 Kg/mm$^2$. Such strength has not been previously attained using any of the nonferrous materials developed to date.

Because the Mn-based alloy of this invention has the quality and structure described above, it can be readily used in the production of a variety of products including, nonmagnetic high resistance materials, nonmagnetic springs, nonmagnetic switch relays, belts, tires and other rubber reinforcements, plastics, concretes and other similar composite materials, and knit and woven fabrics such as fine mesh filters.

The present invention will now be described more specifically below with reference to working examples. However, the present invention is not limited to be following examples.

EXAMPLE 1

An alloy composed of 85 atomic % of Mn, 10 atomic % of Al, and 5 atomic % of C and prepared in a molten state was extruded, under argon gas pressure of 2.5 kg/mm$^2$, through a spinning nozzle of a varying diameter of 0.1 to 1 mm. The extrusion was made onto the surface of a steel roll having a diameter of 20 cm, rotating at a varying speed of 1000 to 5000 rpm, cooled and solidified to produce ribbons of 10 to 500 μm in thickness.

The ribbons thus obtained were noted to trend toward gradual loss of toughness in proportion to growth in thickness. Up to about 500 μm of thickness, however, the ribbons were capable of being bent by 180° and folded fast over themselves without fracture. When the ribbons were tested for texture by observation through an optical microscope, an X-ray diffraction meter and a transmission electron microscope, they were found to be composed of microcrystals of nonequilibrium austenite phase in the structure of a face centered cubic lattice. The crystals measured about 1 to 5 μm. The crystals showed a trend toward gradual growth in particle diameter in proportion to growth in ribbon thickness.

The tough alloy ribbon having a nonequilibrium austenite phase and measuring 200 μm in thickness was tested for tensile strength by an Instron tension tester over a test distance of 2.0 cm at a strain rate of $4.17\times10^{-4}$/sec. The ribbon was found to be a very tough material having tensile strength of 35 kg/mm$^2$, yield strength of 15 kg/mm$^2$, and elongation of 22%.

EXAMPLE 2

An alloy composed of 75 atomic % of Mn, 18 atomic % of Al, and 7 atomic % of C was melted. The molten alloy was extruded, under argon gas pressure of 3.0 kg/cm$^2$, through a spinning nozzle 150 μm in orifice diameter into a cooling water bath 2.5 cm in depth formed centrifugally (350 rpm) within a rotary cylinder 50 cm in diameter, there to be cooled and solidified with the rotating body of cooling water. As the thin wire of alloy of a circular cross section was cooled and solidified, it was continuously wound up on the inner wall of the rotary cylinder. (At this time, the speed of the cooling water ($V_W$) inside the rotary cylinder and the speed of the flow of molten alloy ($V_J$) extruded through the spinning nozzle were adjusted, thus $V_W/V_J=1.15$.)

This operation produced a continuous thin wire of a substantially circular cross section having a uniform diameter of 130 μm.

When this thin wire was tested for texture in the same way as in Example 1, it was found to have a nonequilibrium austenite phase in the structure of a fcc. The particle diameter of the crystals was about 3 μm.

This thin wire was found to be a highly tough material having tensile strength of 40 kg/mm$^2$, yield strength of 25 kg/mm$^2$ and elongation of 4%.

This thin wire was cold drawn, without any process annealing, through a commercially available diamond die up to 79% reduction of area. During the cold drawing, the wire sustained no damage of any sort. Thus, the cold drawing produced a very strong thin wire having a highly uniform tensile strength of 160 kg/mm$^2$, a yield strength of 135 kg/mm$^2$, and an elongation of 1.1%.

EXAMPLE 3

By following the procedure of Example 2, a very tough continuous thin wire having a circular cross section 130 μm in diameter was obtained from an alloy composed of 62 atomic % of Mn, 18 atomic % of Al, 8 atomic % of Cr, 7 atomic % of C, and 5 atomic % of Ta.

When this thin wire was tested for texture by observation through an X-ray diffraction meter and a transmission electron microscope, it was found to have a nonequilibrium austenite phase of crystals 2 to 3 μm in particle diameter. The thin wire had tensile strength of 50 kg/mm$^2$, yield strength of 30 kg/mm$^2$, and elongation of 3.8%. These test results indicate that the addition of Cr and Ta enabled the produced alloy to acquire enhanced toughness and improved tensile strength.

This thin wire was cold drawn, without any process annealing, through a commercially available diamond die to 79% of reduction of area. When the cold drawn wire was tested for tensile strength under the same conditions, it was found to be a heavy-duty wire having tensile strength of 190 kg/mm$^2$, yield strength of 140 kg/mm$^2$, and elongation of 0.8%.

While the invention has been described in detail and with reference to specific embodiments thereof, it will be apparent to one skilled in the art that various changes and modifications can be made therein without departing from the spirit and scope thereof.

What is claimed is:

1. An Mn-based alloy, comprising:

4 to 30 atomic % of at least one element selected from the group consisting of Al, Ni, and Cr;

1 to 15 atomic % of C;

30 atomic % or less of at least one element selected from the group consisting of Co, Mo, W, Ta, Nb, V, Ti, and Zr; and the balance of the alloy to make up 100 atomic % being comprised substantially of Mn, the alloy having a nonequilibrium austenite phase.

2. An Mn-based alloy as claimed in claim 1, wherein the alloy is comprised of from 25 to 95 atomic % of Mn.

3. An Mn-based alloy as claimed in claim 1, wherein the alloy is comprised of from 7 to 26 atomic % of at least one element selected from the group consisting of Al, Ni and Cr.

4. An Mn-based alloy as claimed in claim 1, wherein the alloy is comprised of from 3 to 10 atomic % of C.

5. An Mn-based alloy as claimed in claim 1, wherein the alloy is comprised of 30 atomic % or less of Co.

6. An Mn-based alloy as claimed in claim 5, wherein the alloy is comprised of 20 atomic % or less of at least one element selected from the group consisting of Mo and W.

7. An Mn-based alloy as claimed in claim 5, wherein the alloy is comprised of 10 atomic % or less of at least one element selected from the group consisting of Ta, Nb, V, Ti and Zr.

* * * * *